US009761405B2

(12) United States Patent
Heid et al.

(10) Patent No.: US 9,761,405 B2
(45) Date of Patent: Sep. 12, 2017

(54) X-RAY SOURCE AND THE USE THEREOF AND METHOD FOR PRODUCING X-RAYS

(75) Inventors: Oliver Heid, Erlangen (DE); Timothy Hughes, Erlangen (DE); Jennifer Sirtl, Fürth (DE)

(73) Assignee: SIEMENS AKTIENGESELLSCHAFT (DE)

( * ) Notice: Subject to any disclaimer, the term of this patent is extended or adjusted under 35 U.S.C. 154(b) by 287 days.

(21) Appl. No.: 14/407,654

(22) PCT Filed: Jun. 14, 2012

(86) PCT No.: PCT/EP2012/061297

§ 371 (c)(1),
(2), (4) Date: Dec. 12, 2014

(87) PCT Pub. No.: WO2013/185823

PCT Pub. Date: Dec. 19, 2013

(65) Prior Publication Data

US 2015/0170869 A1 Jun. 18, 2015

(51) Int. Cl.
*H01J 35/10* (2006.01)
*H01J 35/08* (2006.01)
(Continued)

(52) U.S. Cl.
CPC ..... *H01J 35/10* (2013.01); *H01J 35/06* (2013.01); *H01J 35/08* (2013.01); *H01J 35/24* (2013.01);
(Continued)

(58) Field of Classification Search
CPC . H01J 35/08; H01J 2235/087; H01J 2235/081
See application file for complete search history.

(56) References Cited

U.S. PATENT DOCUMENTS 3,825,786 A 7/1974 Einighammer
4,281,269 A 7/1981 Ledley
(Continued)

FOREIGN PATENT DOCUMENTS

CN 1480978 A 3/2004
CN 101413905 A 4/2009
(Continued)

OTHER PUBLICATIONS

International Search Report—PCT/EP2012/061297; International File Date: Jun. 14, 2012; Siemens Aktiengesellschaft; 2 pgs.
(Continued)

*Primary Examiner* — Hoon Song
(74) *Attorney, Agent, or Firm* — Schmeiser Olsen & Watts LLP

(57) ABSTRACT

An x-ray source in which monochromatic x-rays can be produced is provided. A method for producing X-rays and to the use of the x-ray source for x-raying bodies is also provided. A metallic film is arranged in a housing as a target which is bombarded with the electron beam. As a result, the metallic film is excited for emitting monochromatic x-rays, the relatively thin-walled target being modified such that the intended use for producing monochromatic x-rays is no longer possible. Therefore, advantageously, the production device can be pivoted for producing the electron beam as well as being able to wind the target on rollers.

12 Claims, 2 Drawing Sheets

Figure 1:
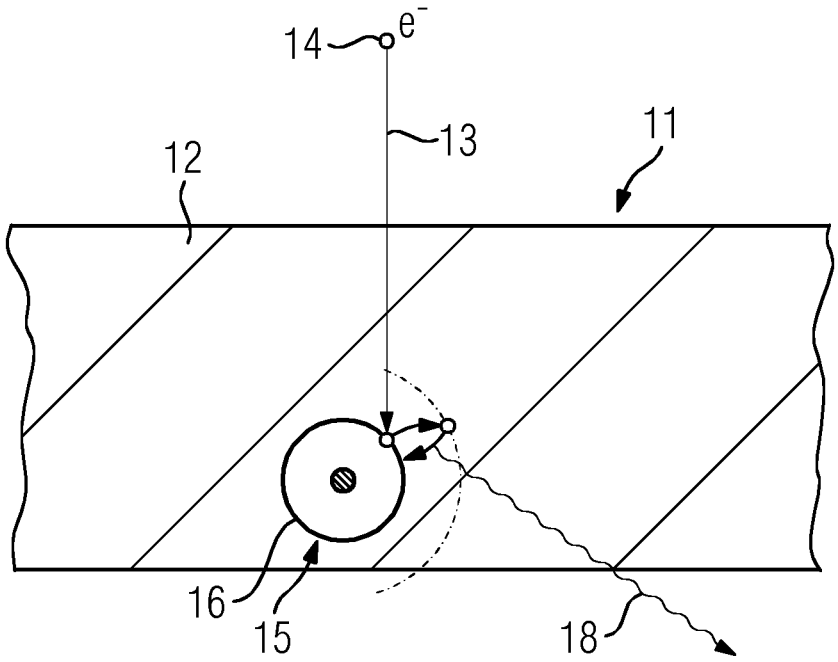

(51) Int. Cl.

| | |
|---|---|
| ***H01J 35/24*** | (2006.01) |
| ***H01J 35/06*** | (2006.01) |
| *H01J 35/22* | (2006.01) |

(52) U.S. Cl.

CPC ..... *H01J 35/22* (2013.01); *H01J 2235/066* (2013.01); *H01J 2235/087* (2013.01)

(56) References Cited

U.S. PATENT DOCUMENTS

| | | | | |
|---|---|---|---|---|
| 4,344,013 | A * | 8/1982 | Ledley | H01J 35/26 378/126 |
| 4,764,826 | A | 8/1988 | Estes | |
| 5,668,848 | A | 9/1997 | Rieger | |
| 6,282,263 | B1 * | 8/2001 | Arndt | H01J 35/14 378/113 |
| 7,436,931 | B2 * | 10/2008 | Harding | H01J 35/08 378/130 |
| 2008/0144774 | A1 | 6/2008 | Antonis | |
| 2012/0051496 | A1 | 3/2012 | Wang et al. | |

FOREIGN PATENT DOCUMENTS

| | | | |
|---|---|---|---|
| JP | S57182953 | A | 11/1982 |
| JP | 62044940 | | 2/1987 |
| JP | H01239740 | A | 9/1989 |
| JP | 297799 | | 8/1990 |
| JP | 4253148 | | 9/1992 |
| JP | H1164598 | A | 3/1999 |
| JP | 2001256909 | A | 9/2001 |
| JP | 2006510192 | A | 3/2006 |
| JP | 2009170306 | A | 7/2009 |
| RU | 2257638 | C1 | 7/2005 |
| SU | 1829882 | | 10/1995 |
| WO | WO 9610324 | A1 | 4/1996 |
| WO | WO 2006069009 | A2 | 6/2006 |

OTHER PUBLICATIONS

Chinese Office Action Issued Dec. 21, 2015; Application No. 201280073907.X; 11 Pgs.

* cited by examiner

X-RAY SOURCE AND THE USE THEREOF AND METHOD FOR PRODUCING X-RAYS

CROSS-REFERENCE TO RELATED APPLICATION

This application claims priority to PCT Application No. PCT/EP2012/061297, having a filing date of Jun. 14, 2012, the entire contents of which is hereby incorporated by reference.

FIELD OF TECHNOLOGY

The following relates to an X-ray source having a housing in which a target is located that can emit X-rays when being bombarded with an electron beam. The following additionally relates to a method for producing X-rays, in which a target in the housing of an X-ray source is bombarded with an electron beam. The following finally also relates to the use of an X-ray source emitting monochromatic X-rays.

BACKGROUND

An X-ray source, the use thereof and a method for producing X-rays of the type mentioned in the introduction are disclosed, for example, in US 2008/014474 A1. According to said document, an X-ray source can be configured by way of example by arranging electrodes within a housing. An electrode having a potential of 0 V produces an electron beam in the housing. An anode, which is used as a target for the electron radiation, is arranged opposite said electrode. Said anode is at 100 kV. Located downstream of the anode is furthermore a collector which is at a potential of 10 kV. When the electron beam strikes the anode, X-rays are released which can be coupled out of the housing through a suitable window (transparent to X-rays) and be supplied for use.

The anode serving as a target may be configured as a thin-walled structure. By way of example, the anode may have a base plate made of boron, having a thickness of between 10 and 200 μm. A thin layer of tungsten having a layer thickness of 0.1 to 5 μm, which is used as a target, is applied on said base plate. However, the very thin tungsten layer is exposed to a high level of stress on account of the electron beam.

SUMMARY

An aspect relates to improving the X-ray source mentioned in the introduction such that a relatively long operating time of the X-ray source is possible without the target needing to be replaced. An additional aspect relates to a method for operating said X-ray source. Finally, an aspect relates to finding a use for such an X-ray source.

Embodiments of the invention by way of the X-ray source specified in the introduction include providing a metal foil as the target material, wherein the electron beam and the target are movable relative to one another. By moving the electron beam generator and/or the metal foil, what is achieved is that the electron beam does not always strike the target at the same site and therefore produces a thermal load only at that site. Instead, the active region on the target produced by the electron beam moves such that local thermal overload can be avoided. It is additionally possible for the electron beam to always be targeted at the target material, the integrity of which is not so damaged that the production of the desired amount of X-rays is no longer ensured (further details relating to the variants for producing the relative movement between the electron beam and the target below).

Overall, by taking the measure according to embodiments of the invention, a longer operating period of the X-ray source can be ensured, because owing to the possible relative movement between target and electron beam, basically a supply of unused target material can be stored in the housing of the X-ray source. Replacement of the target is therefore necessary less frequently, as a result of which it is possible to reliably operate over a long period without replacing the target. As a result, the operation of the X-ray source advantageously also becomes more economical.

According to one advantageous embodiment of the invention, provision is made for the metal foil to be made of a light metal or a plurality of light metals, preferably aluminum. Light metals in the context of the application are intended to designate those metals and the alloys thereof, the density of which is below 5 g/cm$^3$. Specifically, this definition applies to the following light metals: all alkali metals, all alkaline earth metals except for radium, in addition scandium, yttrium, titanium and aluminum. Other advantageous material groups for forming the metal foil are tungsten, molybdenum and the group of the lanthanides. Specifically, this is the element lanthanum and the 14 elements following lanthanum in the periodic table.

The use of a thin metal foil also has the advantage that monochromatic X-rays can advantageously be produced on account of excitation of the target using the electron beam. These are X-rays having only one wavelength, which has the advantage that X-radiographs can be imaged more sharply with monochromatic X-rays, for example. For this reason, an alternative way of achieving embodiments of the invention is also to use said monochromatic X-rays for X-raying a body, which body must be of a nature such that, at the wavelength of the used monochromatic X-rays, contrasts of the body appear on the image. The body may be a mechanical structure (mechanical or inanimate body), such as for example a component connection that is to be examined for air inclusions. Another possibility is to record X-radiographs of a human or animal body.

According to a specific embodiment of the invention, provision is made for the anode to be in the form of a tape which can be unwound from a first roller and be wound onto a second roller. The tape-type configuration of the anode has the great advantage that it can be guided past the electron beam by simple handling steps. As a result, the already mentioned relative movement between the target and the electron beam can be produced. It is particularly advantageous to supply the tape in the form of a roller to the X-ray source and to wind up the used-up tape onto a corresponding roller such that it is easily possible during operation of the X-ray source to reliably store the tape in the housing and supply it to the electron beam. In addition, once the tape is used up, it can be replaced simply by removing the rollers. Particularly advantageously, provision may be made for this purpose for the first roller and the second roller to be housed in vacuum locks of the housing. A vacuum lock within the context of the application is a separate closed-off space within the housing, which space has a through-passage for the tape-type target material toward the interior of the housing. Also present are closable lock openings toward the outside, through which the used-up rollers fit. A roller can then be replaced through venting only the available lock chambers, such that the remaining housing space of the housing remains evacuated. It should be noted in this context that the production of X-rays preferably takes place in an evacuated housing. At least the second roller should advantageously also be coupled mechanically to a drive which is preferably attached on the outside of the housing. Attaching it on the outside of the housing has the advantage that the drive can be maintained relatively easily since it is easily accessible and maintenance work does not necessitate the venting of the housing space.

Another possibility of ensuring a relative movement between an electron beam and the target material is to give the production device for the electron beam a pivotable design. By pivoting the production device, the electron beam also moves to and fro on the target material, as a result of which uniform exposure of the entire target material is possible. Of course, a pivotable production device can also be combined with a roller mechanism. While the roller mechanism can effect a movement of the electron beam on the tape in the direction of the winding direction, the production device can be pivotable in particular perpendicular to the movement direction of the tape. This ensures that the tape can also be utilized over its full width, as a result of which it is possible to utilize the target material in an optimum fashion.

The metal foil advantageously has a thickness of 0.1 μm to 0.5 μm, preferably 0.5 μm. The stated thickness is a technical compromise influenced by the need for the metal foil forming the target to be sufficiently stable so it can be handled, for example, on the rollers. In addition, the target material must also provide a certain resistance to the electron beam, especially since thicker target materials also allow for better heat distribution. Then again, to produce monochromatic X-rays, the target must have a wall which is as thin as possible.

BRIEF DESCRIPTION

Figure 2:
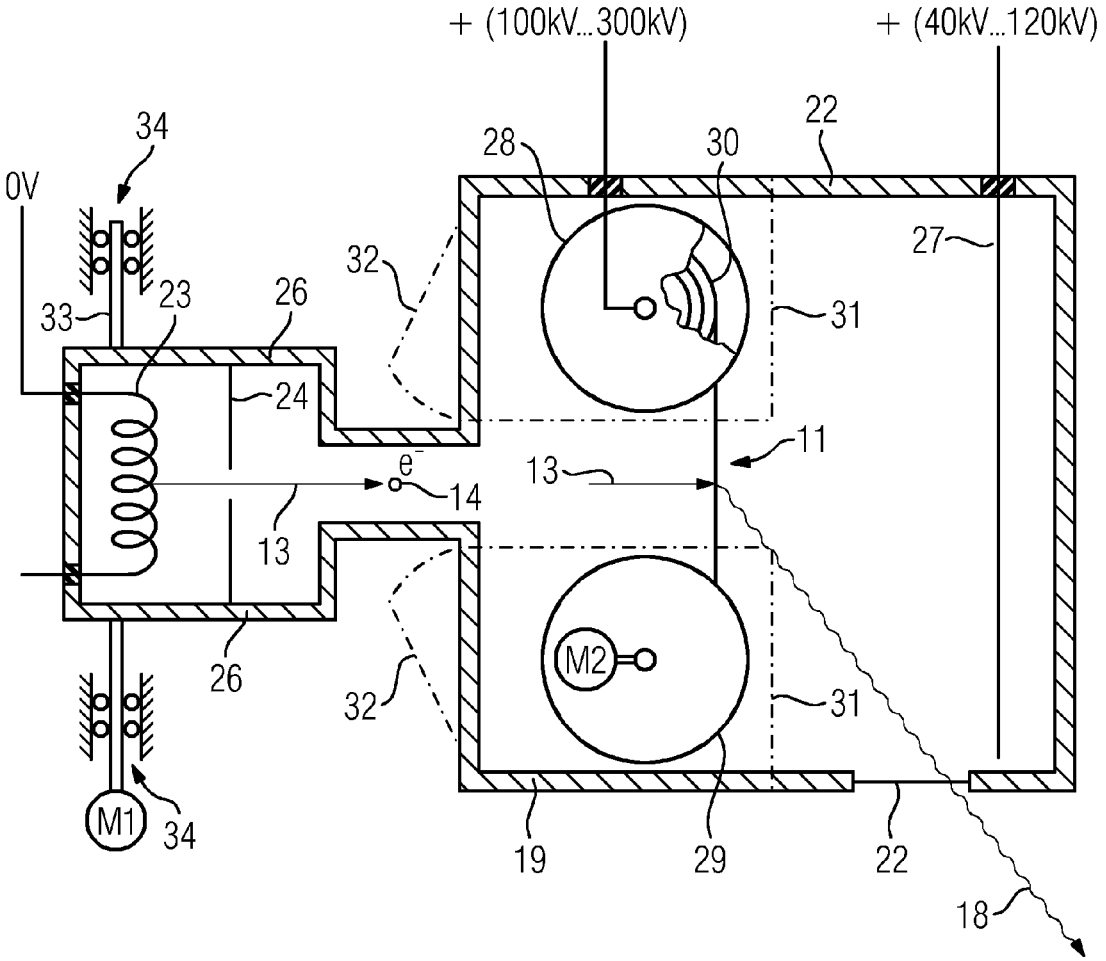

Some of the embodiments will be described in detail, with reference to the following figures, wherein like designations denote like members, wherein:

FIG. 1 schematically illustrates the production of monochromatic X-rays in a foil in a schematic section; and FIG. 2 shows an exemplary embodiment of the X-ray source in schematic section.

DETAILED DESCRIPTION

In FIG. 1, a metal foil 12 (illustrated as a detail) is provided as the target 11. An electron beam 13 strikes, with electrons 14, an atom 15 of the target material (for example aluminum). Also illustrated is the K-shell 16 of the atom 15, wherein the electron beam causes excitation of one of the electrons 17 of the K-shell 16 up to a different shell. When these electrons jump back, monochromatic X-rays 18 are emitted.

FIG. 2 shows the construction of the X-ray source according to embodiments of the invention. The X-ray source itself is housed in an evacuable housing 19 which has a window 22. The electron beam 13 enters the housing 19. Subsequently, the electron beam strikes the target 11, wherein said target absorbs hardly any energy of the electron beam owing to its low thickness. However, part of the energy is converted, owing to an excitation of the atoms 15 (see FIG. 1) in the already described manner, into monochromatic X-rays 18 which can then leave the housing through the window 22. In order to accelerate the electrons 14 in the electron beam 13 sufficiently, what is known as an E-gun (i.e. an electron gun) is provided. Said E-gun has a cathode 23 which emits electrons if an electrical field is present. Said electrons are bundled using a lens 24. The electrical field is established by switching the target as an anode. Said anode can be operated at a potential of 100 to 300 kV, wherein a collector 27 at a potential of 40 to 120 kV is additionally used downstream of the target. The collector electrostatically decelerates the electron beam 13 which has nearly completely passed the target 11 and extracts the kinetic energy therefrom. The low-energy electrons of the decelerated beam are absorbed by the collector and conducted away as current.

Also provided in the housing are a first roller 28 and a second roller 29. The target, which is present in the form of a tape 30, is wound onto the first roller 28 and is driven in a manner which is not illustrated further using an actuator M2 (located outside the housing in a manner known per se on a drive shaft for rotating the roller 29). In the process, the target 11 is unwound from the roller 28 and wound onto the roller 29. To permit simple replacement of the rollers 28, 29, vacuum locks 31, which are indicated in dashed-dotted lines, are provided such that the remaining space of the housing need not be vented when the rollers 28, 29 are replaced. The rollers 28, 29 are removed through the indicated doors 32.

The electron gun is likewise mounted pivotably via a shaft 33. It is driven using a motor M1. The shaft 33 is parallel to the plane of the drawing in mounts 34, such that by pivoting the electron gun, the electron beam 13 can be pivoted over the entire width of the tape 30. The effect of the driving of the rollers 28, 29 is that the electron beam can also change the site of impact on the target in the direction of the longitudinal extent of the tape 30.

The invention claimed is:

1. An X-ray source having a housing in which a target is located that emits X-rays when being bombarded with an electron beam, wherein a metal foil is the target, and the electron beam is pivotable and the target is movable, such that the electron beam is capable of striking the target at a different location along a width of the target.

2. The X-ray source as claimed in claim 1, wherein the metal foil is made of at least one of a light metal and a plurality of light metals.

3. The X-ray source as claimed in claim 1, wherein the metal foil comprises at least one of a lanthanide, tungsten, molybdenum, and an alloy of at least two thereof.

4. The X-ray source as claimed in claim 1, wherein an anode is in a form of a tape, which is unwound from a first roller and wound onto a second roller.

5. The X-ray source as claimed in claim 4, wherein the first roller and the second roller are housed in vacuum locks of the housing.

6. The X-ray source as claimed in claim 4, wherein the second roller is mechanically coupled to a drive that is attached on an outside of the housing.

7. The X-ray source as claimed in claim 1, wherein a production device for the electron beam is of a pivotable design.

8. The X-ray source as claimed in claim 1, wherein the metal foil has a thickness of 0.1 μm to 0.5 μm.

9. A method for producing X-rays, in which a target in a housing of an X-ray source is bombarded with an electron beam and emits X-rays, wherein a metal foil is used as the target, and the electron beam is pivotable and the target is movable, such that the electron beam is capable of striking the target at a different location along a width of the target.

10. The method as claimed in claim 9, wherein monochromatic X-rays are produced using the target.

11. A method comprising:

utilizing an X-ray source emitting monochromatic X-rays as claimed in claim 1 for X-raying a body, which produces differentiable contrasts at a wavelength of the X-rays used.

12. The X-ray source as claimed in claim 1, wherein the metal foil is comprised of aluminum.

* * * * *